US009278799B2

(12) United States Patent
Yamada

(10) Patent No.: US 9,278,799 B2
(45) Date of Patent: Mar. 8, 2016

(54) WET TISSUE PACKAGE

(76) Inventor: Kikuo Yamada, Tokyo (JP)

( * ) Notice: Subject to any disclaimer, the term of this patent is extended or adjusted under 35 U.S.C. 154(b) by 0 days.

(21) Appl. No.: 14/124,840

(22) PCT Filed: Jul. 3, 2012

(86) PCT No.: PCT/JP2012/004309
§ 371 (c)(1),
(2), (4) Date: Dec. 9, 2013

(87) PCT Pub. No.: WO2013/005421
PCT Pub. Date: Jan. 10, 2013

(65) Prior Publication Data

US 2014/0124402 A1 May 8, 2014

(30) Foreign Application Priority Data

Jul. 6, 2011 (JP) ..... 2011-149712

(51) Int. Cl.
*B65D 83/08* (2006.01)
*B65D 81/22* (2006.01)
*A47K 10/32* (2006.01)

(52) U.S. Cl.
CPC ..... *B65D 83/0805* (2013.01); *B65D 81/22* (2013.01); *A47K 2010/3266* (2013.01)

(58) Field of Classification Search
CPC ..... B65D 81/22; B65D 83/0805; A47K 2010/3266
USPC ..... 206/205, 210, 233, 449, 494, 812; 221/33, 34, 45, 48, 63, 56; 383/66, 211
See application file for complete search history.

(56) References Cited

U.S. PATENT DOCUMENTS 4,848,575 A * 7/1989 Nakamura et al. ..... 206/449
4,863,064 A * 9/1989 Dailey, III ..... 221/48
5,325,992 A * 7/1994 Koller et al. ..... 221/63
5,542,567 A * 8/1996 Julius ..... 221/63
5,582,294 A * 12/1996 Yamada ..... 206/494

(Continued)

FOREIGN PATENT DOCUMENTS

EP 0331027 B1 1/1992
JP H01-226579 A 9/1989

(Continued)

OTHER PUBLICATIONS

Sep. 18, 2012 International Search Report issued in International Application No. PCT/JP2012/004309, (1 page).

(Continued)

*Primary Examiner* — Luan K Bui
(74) *Attorney, Agent, or Firm* — Oliff PLC

(57) ABSTRACT

To provide wet tissue packing body with which drying of a wet tissue may be prevented by seal-packaging a tip portion of a following wet tissue that protrudes from a tissue hole when one wet tissue is taken out of the packing body. A wet tissue packing body of the present invention includes an air-tight bag body accommodating a wet tissue, a wet tissue hole forming member disposed at an inner side around an opening of the bag body, and a cover member which seals the bag body opening. The wet tissue hole forming member includes a concave space to accommodate a wet tissue which protrudes from a wet tissue hole, and a flat cross section of the concave space is larger than the opening area of the bag body opening.

20 Claims, 10 Drawing Sheets

5 Wet tissue
6 Outlet member
7 Concave space
8 Wet tissue drawing hole

(56) References Cited

U.S. PATENT DOCUMENTS

| | | | | |
|---|---|---|---|---|
| 5,938,013 | A * | 8/1999 | Palumbo et al. | 206/210 |
| 7,621,401 | B2 * | 11/2009 | Alegre de Miquel | 206/494 |
| 7,794,382 | B2 * | 9/2010 | Cheich | 206/494 |

FOREIGN PATENT DOCUMENTS

| | | | |
|---|---|---|---|
| JP | H06-292639 | A | 10/1994 |
| JP | A-10-077076 | | 3/1998 |
| JP | A-2001-145582 | | 5/2001 |
| JP | A-2001-275876 | | 10/2001 |
| JP | 2003-312757 | A | 11/2003 |

OTHER PUBLICATIONS

Jan. 28, 2015 Office Action issued in Japanese Application No. 2013-522468.

* cited by examiner

1 Wet tissue package
2 Bag body
3 Opening
4 Cover

5 Wet tissue

6 Outlet member

7 Concave space

8 Wet tissue drawing hole

13 Communicating portion

WET TISSUE PACKAGE

TECHNICAL FIELD

The present invention relates to a wet tissue package that stores and packages wet tissues in a bag body.

BACKGROUND

Wet tissues are widely used for wiping one's hands or the buttocks of infants, sick persons, or old persons. A wet tissue is base fabric such as nonwoven fabric impregnated with a chemical such as a cleaning liquid, an antiseptic liquid or the like and is normally stored in a sealed storage container to be able to maintain a state in which the base fabric is wet with a chemical or the like. A bottle-type storage container in a cylindrical shape has widely been used, but a bottle-type wet tissue package stores a wet tissue wound as a roll vertically in an storage container and thus, it is difficult to make the container compact, posing a problem of larger sizes of the storage container and higher manufacturing costs. In recent years, therefore, instead of the bottle-type wet tissue package, a bag-type wet tissue package enabling one to take out one folded wet tissue at a time by storing and packaging folded wet tissues in a bag body is increasingly used.

As a bag-type wet tissue package, a wet tissue package configured such that a wet tissue drawing hole forming member or an outlet member formed a wet tissue drawing hole at the bottom portion is mounted on the inner side around a bag body opening formed from a film having airtightness or the like and a wet tissue inside the packing body is taken out from the bag body opening through the wet tissue drawing hole is widely used (see, for example, Patent Literature 1).

CITATION LIST

Patent Literature

Patent Literature 1: JP 10-77076 A

SUMMARY OF INVENTION

Technical Problem

Wet tissues stored inside the bag-type wet tissue package in a folded state can be taken out one wet tissue after another by tearing along the perforation or the like. The opening of the bag body is sealed with a cover such as a cover unit member or an airtight film and the method of folding wet tissues and the shape of the drawing hole are devised such that when the cover is unsealed and a wet tissue is pulled to take out the wet tissue, the tip portion of the next wet tissue is protruded from the drawing hole. If a wet tissue with the tip portion thereof protruded from the wet tissue drawing hole is left alone, the wet tissue is dried and it is necessary to seal the opening of the bag body again if there is some time before the wet tissue is used next time and the tip portion of the wet tissue protruding from the drawing hole is stored in a space between the drawing hole and the opening of the bag body. However, a conventional bag-type wet tissue package has only a narrow space formed between the wet tissue drawing hole and the opening of the bag body and thus, even if an attempt is made to seal the opening of the bag body with the cover, it is difficult to reliably seal and store the tip portion of the wet tissue protruding from the drawing hole in the space between the drawing hole and the opening of the bag body. Particularly if the remaining amount of wet tissue in the bag body decreases, the volume of the tip portion of the wet tissue protruding after being pulled out from the drawing hole increases. Thus, it becomes difficult to seal and store the tip portion protruding from the drawing hole reliably in the storage space. In addition, there is a problem of an increased size of the whole packing body if the volume of the storage space is increased by increasing the depth from the opening of the bag body to the bottom portion of the outlet member and also a problem that if an attempt is made to retain the size of the packing body, it is unavoidable to reduce the amount of wet tissue stored in the bag body.

The present invention is made to solve such conventional problems and an object thereof is to provide a bag-type wet tissue package or wet wipe package capable of reliably seal and store the tip portion of a wet tissue protruding from the drawing hole in the space between the drawing hole and the opening of the bag body.

Solution to Problem

Namely, the gist of the present invention is (1) a wet tissue package having an airtight bag body storing wet tissues, an outlet member formed a wet tissue drawing hole mounted on an inner side around an opening of the bag body, and a cover that seals the opening of the bag body, wherein the outlet member includes a concave space to store a wet tissue protruding from a wet tissue drawing hole and is formed such that a plane cross section of the concave space is larger than an opening area of the opening of the bag body, (2) the wet tissue package according to (1) above, wherein the outlet member includes a bottom portion where the wet tissue drawing hole is formed, a side wall rising from the bottom portion, and a flange portion provided on an edge of an upper end and the concave space is formed between the bottom portion and the side wall of the outlet member mounted around the opening of an inner surface of the bag body and the bag body, (3) the wet tissue package according to (1) above, wherein at least a portion of the side wall of the outlet member has a shape of communicating through the bag body, (4) the wet tissue package according to (1) above, wherein the wet tissue drawing hole is formed by a picking portion from which the wet tissue in the packing body is picked and pulled up and a pulling portion linked to the picking portion, (5) the wet tissue package according to (4) above, wherein the wet tissue is folded and stored such that a folding line of the wet tissue is perpendicular to a direction connecting the picking portion and the pulling portion of the wet tissue drawing hole, (6) the wet tissue package according to (1) above, wherein the outlet member is mounted in a recessed position on the inner side from an edge of the opening of the bag body, (7) the wet tissue package according to (2) above, wherein the outlet member is mounted around the opening of an inner surface of the bag body via the flange portion formed by overhanging from the edge of the upper end portion of the outlet member to an outer side, (8) the wet tissue package according to (1) above, wherein the outlet member is configured by processing and forming the wet tissue drawing hole in a plate body, and (9) the wet tissue package according to (2) above, wherein the outlet member is configured by processing and forming the wet tissue drawing hole and the flange portion in a plate body.

Advantageous Effects of Invention

A plane cross section of a concave space of a outlet member is formed larger than an opening area of an opening of a bag body in a wet tissue package in the present embodiment; therefore, the volume of the concave space is large and drying of a wet tissue can be prevented by reliably sealing and storing a tip portion of the wet tissue protruding from an drawing hole in the concave space.

If at least a portion of a side wall of the outlet member communicates through the bag body, the inside of the bag body can also be used as the concave space; therefore, the size of the outlet member can be made smaller.

If the concave space is formed by the outlet member being mounted around the opening on an inner surface of the bag body via a flange portion formed by overhanging from an edge of an upper end portion of the outlet member to an outer side, a sufficient volume of the concave space can be secured.

The outlet member can be manufactured by a simple method of processing and forming the drawing hole in a plate body or processing and forming the drawing hole and the flange portion in a plate body.

BRIEF DESCRIPTION OF DRAWINGS

FIG. 1A is a perspective view of a state in which a cover is closed, and FIG. 1B is a perspective view of a state in which the cover is open.

REFERENCE SIGNS LIST

Figure 1A:
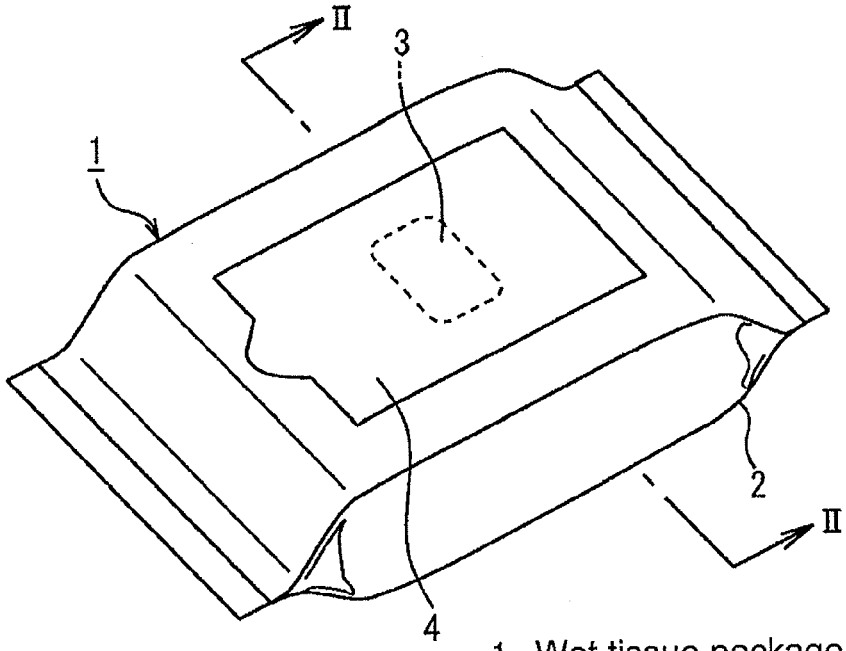
FIGS. 1A and 1B show an embodiment of a wet tissue package.

1 Wet tissue package
2 Bag body
3 Opening
4 Cover
5 Wet tissue
6 Outlet member
7 Concave space
8 Wet tissue drawing hole
13 Communicating portion

DESCRIPTION OF EMBODIMENT

Figure 1B:
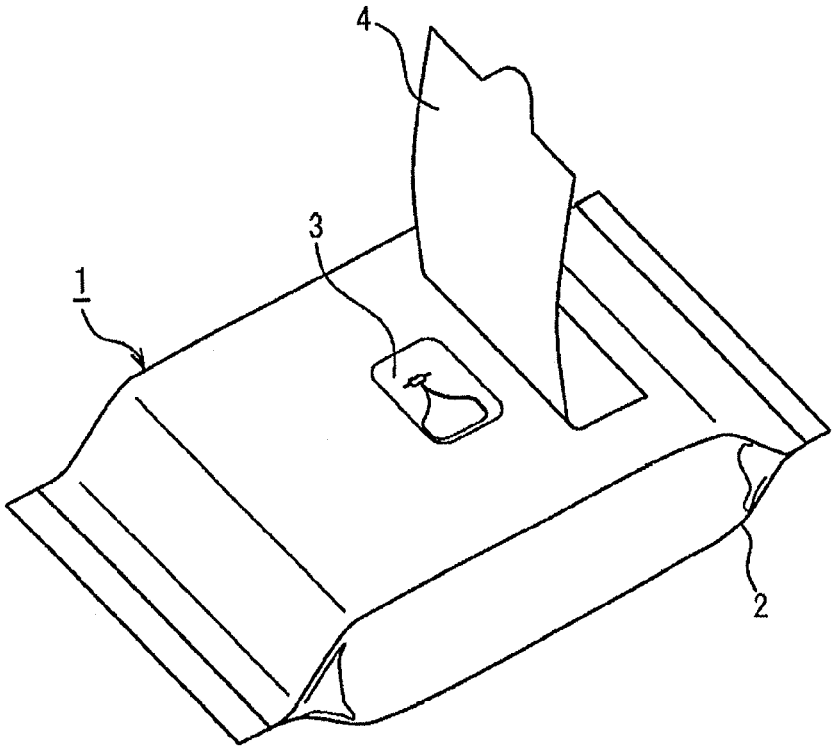
Figure 2:
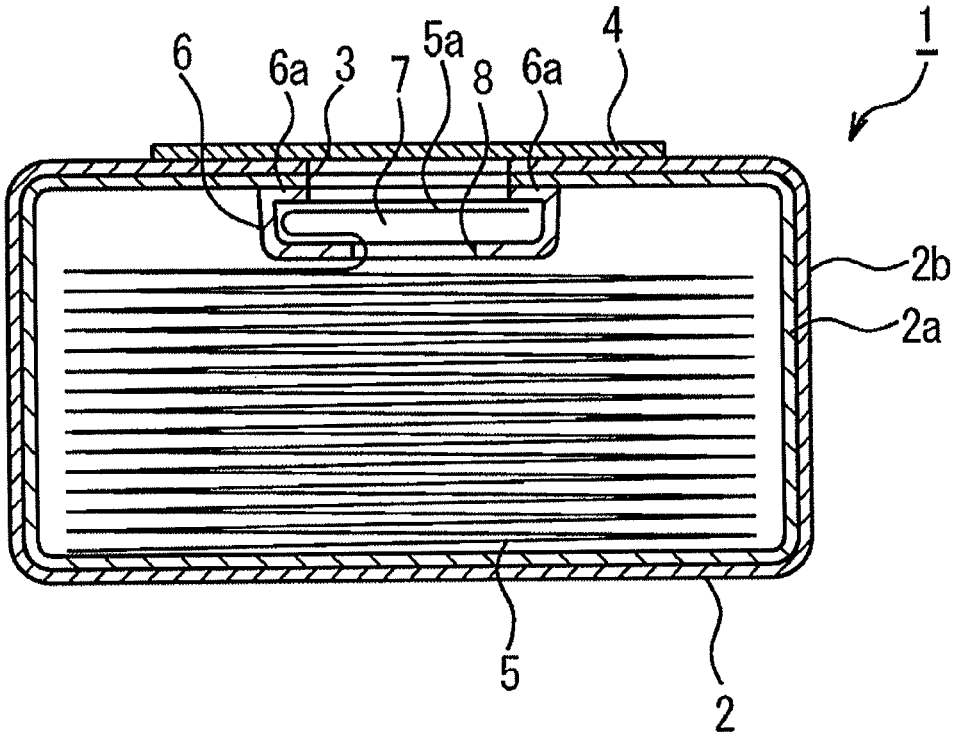
FIG. 2 is a longitudinal sectional view along II-II line in FIG. 1A.

FIG. 1 shows an outside configuration of a wet tissue package 1 of the present invention and reference numeral 2 is a bag body, reference numeral 3 is an opening of the bag body 2, a reference numeral 4 is a cover. FIG. 1A shows a state in which the opening 3 of the bag body 2 is sealed with the cover 4 made of an airtight film or sheet and FIG. 1B shows a state in which the opening 3 is unsealed by opening the cover 4. As shown in FIG. 2, folded wet tissues 5 are stored inside the bag body 2.

The bag body 2 is formed in a bag shape such as a pillow shape as shown, for example, in FIGS. 1A and 1B by sealing ends of the plastic sheet or film having airtightness with a heat seal or the like. The bag body 2 is made of an airtight material and is formed of, as shown, for example, in FIG. 2, a 2-layer layered product of an inner layer 2*a* and an outer layer 2*b*. A layered product of one or two or more of, for example, polyethylene, polypropylene, polyester, polyamide, vinyl chloride, vinylidene chloride, and cellophane or a complex obtained by further stacking aluminum foil is used as the inner layer 2*a*, and polyethylene terephthalate (PET) or the like is used as the outer layer 2*b*. In the present embodiment, the bag body 2 is formed of the two layers of the inner layer 2*a* and the outer layer 2*b*, but is not limited to such an example and may be formed of multiple layers of three layers or more, or one layer. In addition, materials used for the inner layer 2*a* and the outer layer 2*b* are not limited to the above materials.

The wet tissues 5 are ground fabric such as nonwoven fabric impregnated with a chemical such as a cleaning agent, an antibacterial or the like and are stored in the bag body 2 after being folded. The wet tissues 5 are folded and stored such that the wet tissues can be taken out one by one.

An outlet member formed a wet tissue drawing hole 6 is mounted on the inner side of a periphery of the opening 3 of the bag body 2. The outlet member 6 is made of paper, synthetic resin, metal or the like and is formed from, for example, a puched molded body of paper, a synthetic resin sheet or film, a thermal molded body of a thermoplastic resin sheet or film, an injection molded body of thermoplastic resin or the like. The outlet member 6 is formed in a box shape having a concave space 7 as shown, for example, in FIG. 3 and a flange portion 6*a* formed by overhanging to the inner side of the edge of the upper end portion is fixed to and mounted on the periphery of the opening 3 of the bag body 2. A wet tissue drawing hole 8 through which the wet tissue 5 in the bag body 2 is taken out is provided at the bottom portion of the outlet member 6. The outlet member 6 is fixed to the bag body 2 by an emulsion adhesive, a hot-melt adhesive, a heat seal or the like. The concave space 7 of the outlet member 6 is a space in which a tip portion 5*a* of the wet tissue 5 to be taken out next is stored and the wet tissue package 1 in the present invention has the outlet member 6 formed such that the plane cross section of the concave space 7 is larger than the opening area of the opening 3 of the bag body 2 to allow the tip portion 5*a* of the wet tissue protruding from the wet tissue drawing hole 8 to be sealed and stored reliably in the concave space 7. The outlet member 6 shown in FIG. 3 has the flange portion 6*a* to mount the outlet member 6 on the periphery of the opening 3 of the bag body 2 formed by overhanging from the edge of the upper end portion of the outlet member 6 to the inner side and is configured so that the plane cross section of the concave space 7 is larger than the opening area of the opening 3.

Figure 4:
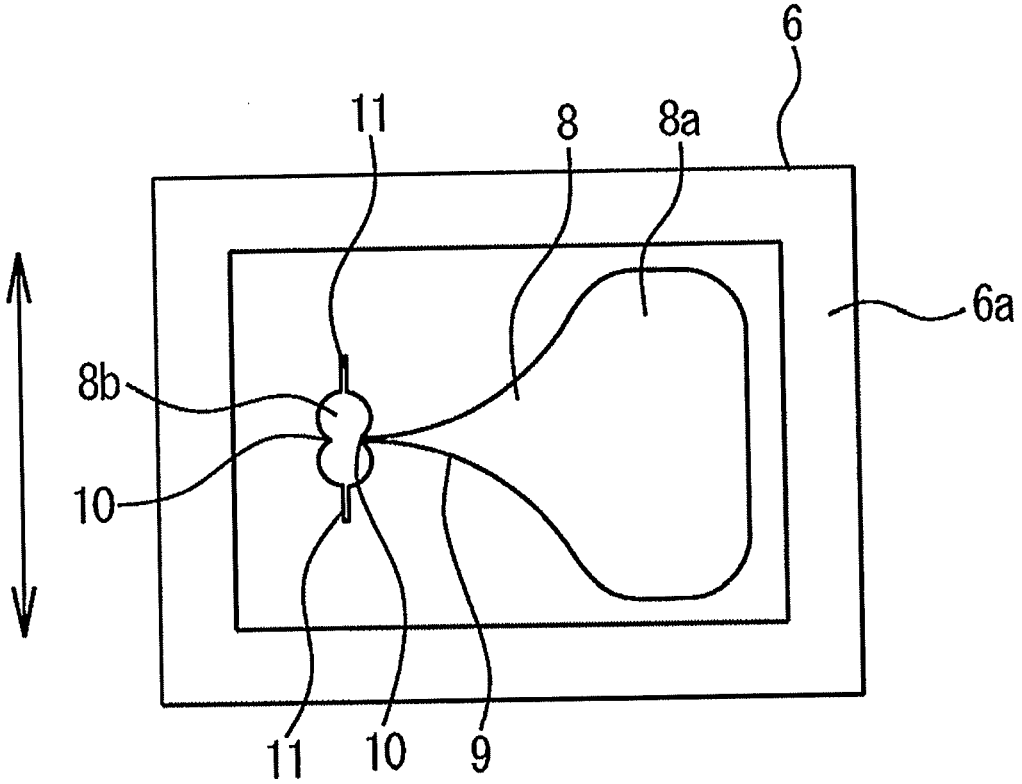
FIG. 4 is a plan view of the outlet member.
Figure 5A:
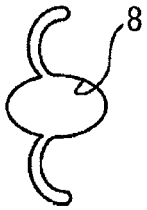
FIGS. 5A to 5H are plan views showing different shapes of a wet tissue drawing hole.
Figure 5B:
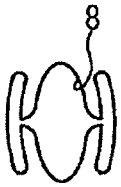
Figure 5C:
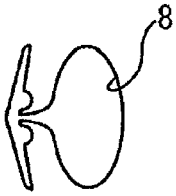
Figure 5D:
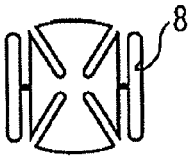
Figure 5E:
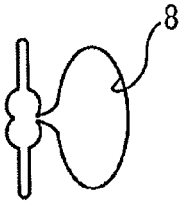
Figure 5F:
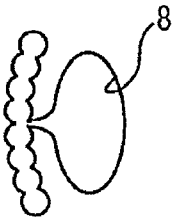
Figure 5G:
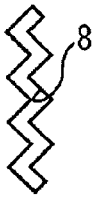
Figure 5H:
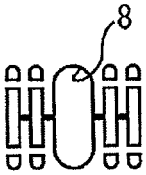

The wet tissue drawing hole 8 is configured such that the wet tissue 5 stored in the packing body 2 is taken out one by one and, as shown, for example, in FIG. 4, a picking portion 8*a* and a pulling portion 8*b* whose opening area is smaller than that of the picking portion 8*a* are linked via a tapering portion 9 of the picking portion 8*a*. The pulling portion 8*b* is provided with a protrusion 10 to apply a load to the wet tissue to be pulled out and a slit 11 to allow the wet tissue to be taken out easily one wet tissue after another by providing an elastic force to the load applied to the wet tissue by the protrusion 10. The wet tissue drawing hole 8 is not limited to the shape shown in FIG. 4, and any shape allowing the wet tissue 5 to be taken out one by one may be adopted and various shapes shown in, for example, FIGS. 5A to 5H may be adopted.

Figure 6:
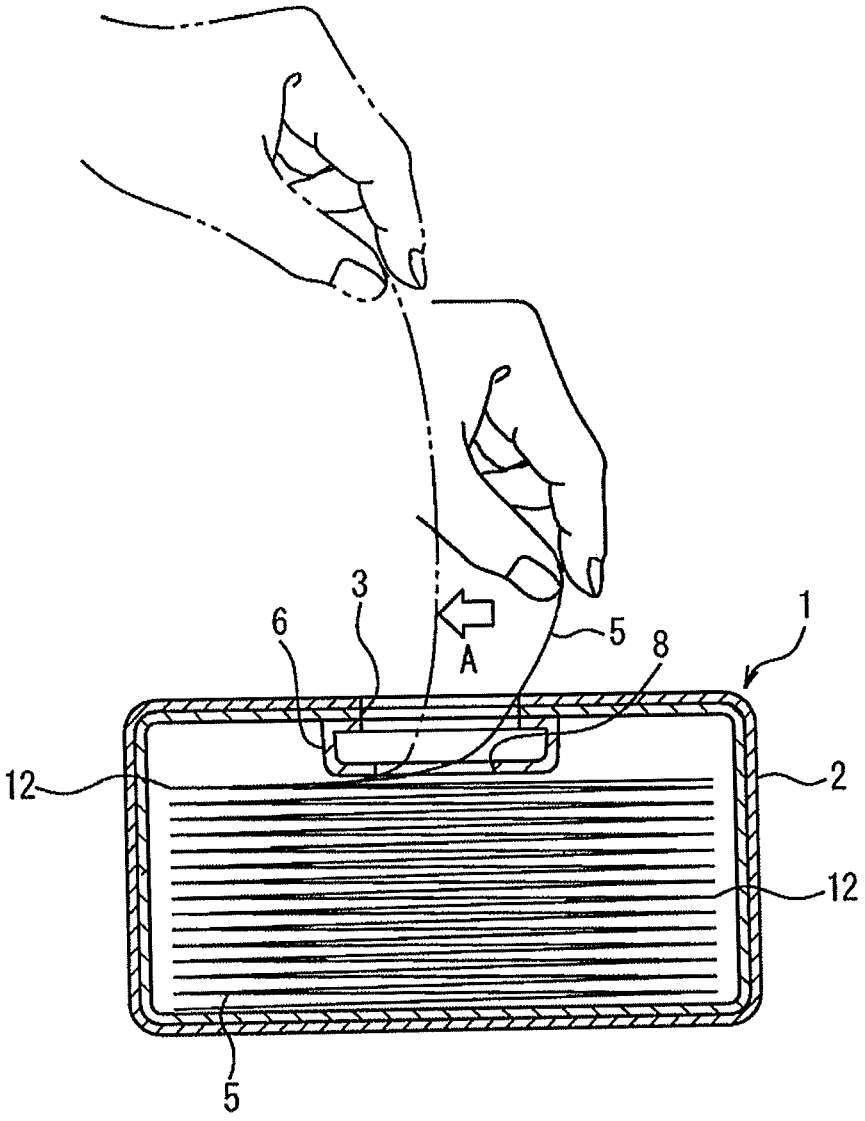
FIG. 6 is an explanatory view showing an operation when a wet tissue is taken out from a bag body.

When the user uses the wet tissue package 1 for the first time, the tip portion 5*a* of the wet tissue 5 does not protrude into the concave portion 7 after the cover 4 being unsealed. Thus, as shown in FIG. 6, the user picks and pulls up the wet tissue 5 in the packing body 1 from the picking portion 8*a*. At this point, with a folding line 12 of the folded wet tissue 5 being stored inside the bag body 2 so as to be in a direction perpendicular to the direction connecting the picking portion 8*a* and the pulling portion 8*b* of the drawing hole 8 (direction along an arrow in FIG. 4), the wet tissue 5 moves in the direction of an arrow A in FIG. 6 and moves from the picking portion 8*a* to the pulling portion 8*b* via the tapering portion 9 while being pulled up. At this point, a load is applied to the wet tissue by the tapering portion 9 and the protrusion 10 and if the wet tissue is further pulled up, a first wet tissue and a second wet tissue are separated while the tip portion 5*a* of the second wet tissue protrudes from the pulling portion 8*b*. Then, when the second or subsequent wet tissue is pulled out, the tip portion 5*a* of the wet tissue protrudes from the pulling portion 8*b* and so the protruding tip portion 5*a* can be picked and pulled up to take out the second wet tissue and because a load is applied to the wet tissue 5 by the protrusion 10 of the pulling portion 8*b*, the second and third wet tissues are separated while the tip portion 5*a* of the third wet tissue protrudes from the pulling portion 5*b*.

When the wet tissue 5 is not further taken out, drying of the remaining wet tissue can be prevented by storing the tip portion 5*a* inside the concave space 7 and sealing the opening 3 of the bag body 2 with the cover 4. The packing body 1 in the present invention is formed such that the plane cross section of the concave space 7 is larger than the opening area of the opening 3 and the volume of the concave space 7 and thus, when the remaining amount of the wet tissue 5 in the bag body 2 is small or even when the amount of protrusion of the tip portion 5*a* of the next wet tissue protruding from the wet tissue drawing hole 8 because the pull-up force when a wet tissue is pulled out is too strong, drying can be prevented by reliably storing and sealing the protruding tip portion 5*a* inside the concave space 7.

When, like the illustrated packing body 1, the opening 3 of the bag body 2 is sealed with the sheet-like cover 4, the cover 4 pasted to the vicinity of the opening 3 via an adhesive layer so that the opening 3 can repeatedly be sealed and unsealed with the cover 4. As the adhesive, for example, an adhesive mainly containing an acrylic fabric size, polyvinyl chloride composition containing plasticity, craft copolymer in which an ethylene-vinyl acetate copolymer is craft-polymerized with an vinyl chloride monomer or the like can be cited, but is not limited to the above examples if the adhesive is capable of repeatedly paste and separate the cover 4. Though not particularly illustrated, instead of the sheet-like cover 4, a lid provided by integral formation with the outlet member 6 may be configured to be removable from the opening 3 to seal and unseal the opening 3.

Figure 3:
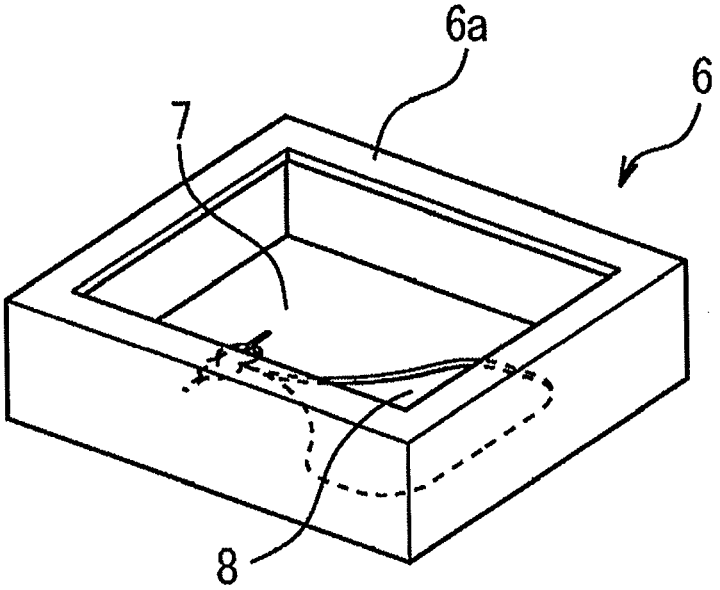
FIG. 3 is a perspective view exemplifying an outlet member formed a wet tissue drawing hole.
Figure 7:
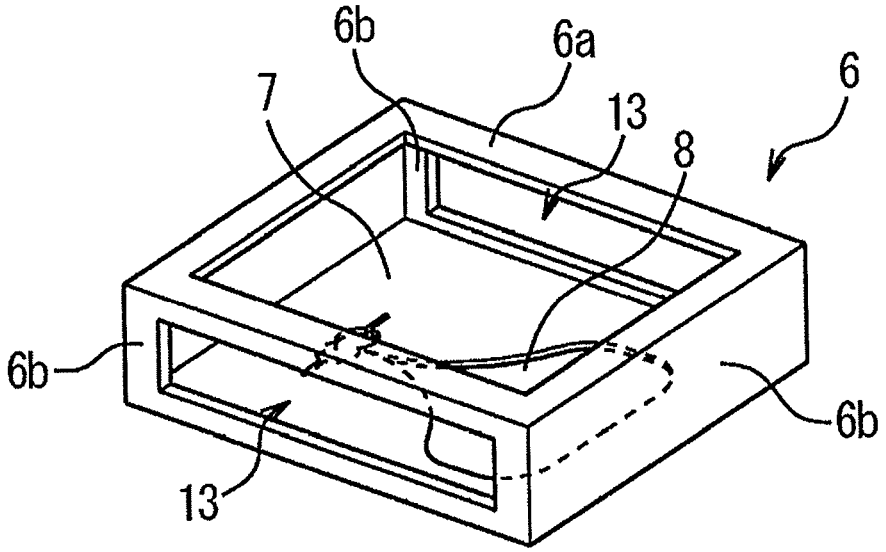
FIG. 7 is a perspective view showing a different mode of the outlet member.
Figure 11:
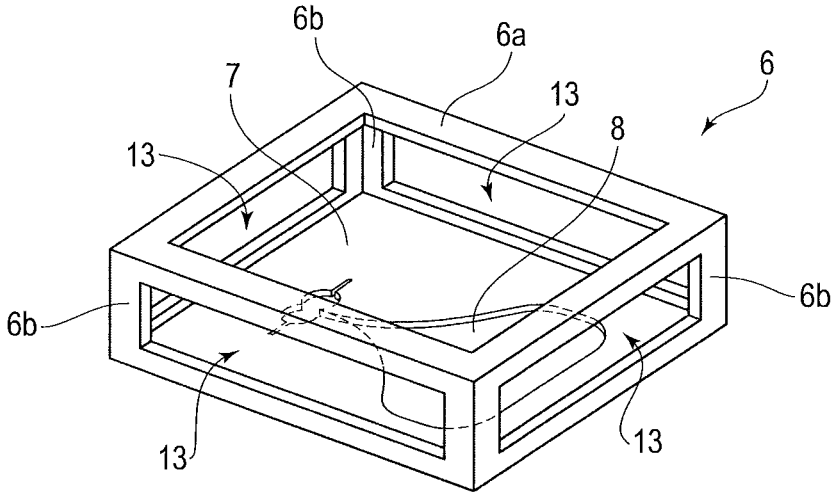
FIG. 11 is a perspective view showing a different mode of the outlet member.

The outlet member 6 is not limited to the shape shown in FIG. 3 and any shape capable of making the plane cross section of the concave space 7 larger than the opening area of the opening 3 of the bag body may be adopted and, as shown in FIG. 7, a shape in which a communicating portion 13 communicating through the bag body 2 in at least a portion of a side wall 6*b* may be adopted. If the communicating portion 13 is provided, the space inside the bag body 2 can also be used as the concave space 7 to accommodate the tip portion 5*a* of the wet tissue 5 and so the size of the outlet member 6 can be made smaller. In the example shown in FIG. 7, while the communicating portion 13 is provided only on the opposing two sides of the side walls 6*b* of four sides, the communicating portion 13 may also be provided in the side walls 6*b* of all the four sides, as illustrated in FIG. 11. When the communicating portion 13 is provided in the side wall 6*b*, the flange portion 6*a* is not limited to one formed by overhanging from the edge of the upper end portion of the outlet member 6 to the inner side and may be formed by overhanging to the outer side. Even when the aforementioned flange portion 6*a* is mounted along the edge of the opening 3 of the bag body 2 or mounted on the bag body 2, as in a different mode (FIG. 9) described later, in a position on the inner side from the edge of the opening 3, the plane cross section of the concave space 7 can be formed larger than the opening area of the opening 3.

Figure 8A:
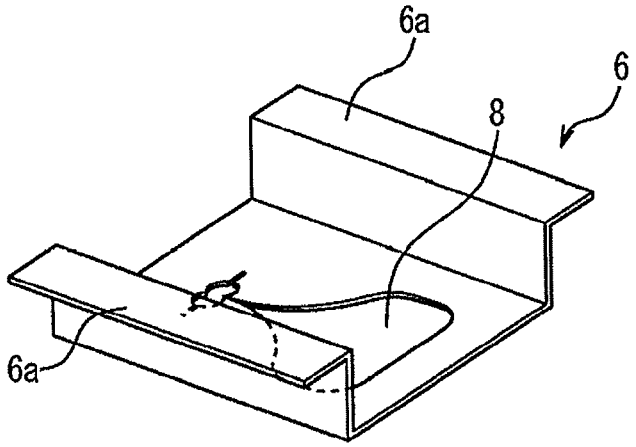
FIGS. 8A to 8C are perspective views showing different modes of the outlet member.
Figure 8B:
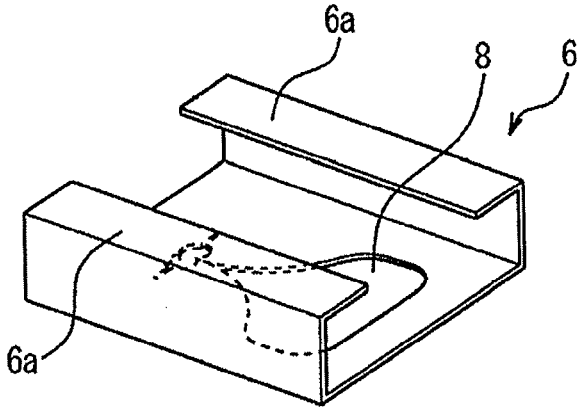
Figure 8C:
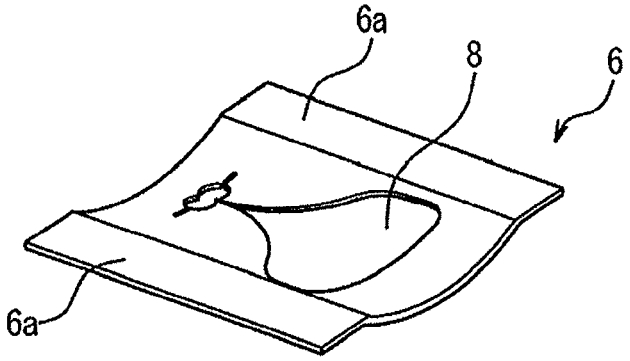

As the outlet member 6 having the communicating portion 13 in which at least a portion of the side wall 6*b* communicates through the bag body 2, the outlet member 6 in the shapes shown in FIG. 8A, 8B, or 8C can be used. While the outlet member 6 in the shapes shown in FIGS. 3 and 7 is normally manufactured by injection molding, the outlet member 6 as shown in FIG. 8A, 8B, or 8C can be manufactured by a simple method such as stamping the drawing hole 8 in a plate body of synthetic resin and then pressing the plate body into a right-angle shape or a curved shape, or stamping the drawing hole 8 in a long molded body formed by extrusion and cutting the molded body.

Figure 9:
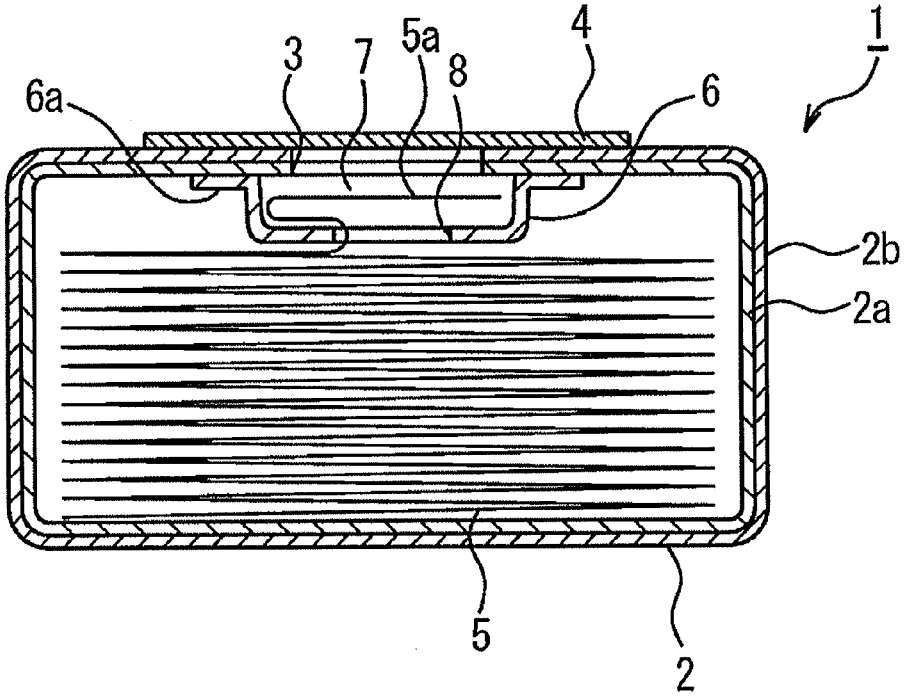
FIG. 9 is a longitudinal sectional view of a different mode of the wet tissue package.

FIG. 9 shows a different mode of the wet tissue package 1 of the present invention. The wet tissue package 1 has as the outlet member 6 a shape in which the flange portion 6*a* is formed by overhanging from the edge of the upper end portion of the outlet member 6 to the outer side, but is formed such that the plane cross section of the concave space 7 is larger than the opening area of the opening 3 of the bag body 2 by mounting the flange portion 6*a* on the bag body 2 in a recessed position on the inner side from the edge of the opening 3 of the bag body 2; therefore, a sufficient volume of the concave space 7 can be secured and the tip portion 5*a* of the wet tissue 5 protruding from the wet tissue drawing hole 8 to the concave space 7 can reliably be sealed and stored inside the concave space 7.

Figure 10A:
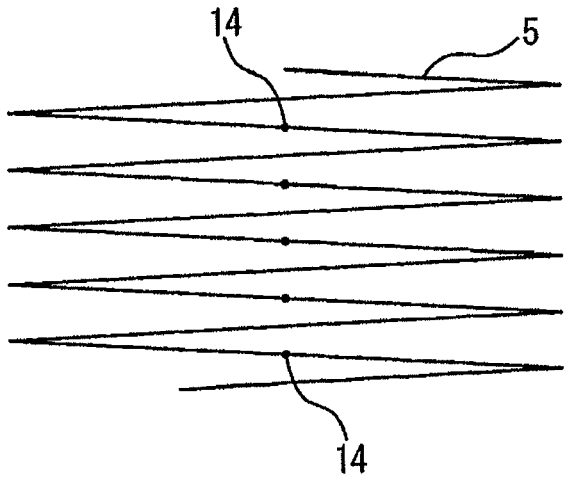
FIG. 10A to 10C are schematic diagrams shows forms of folding wet tissues.
Figure 10B:
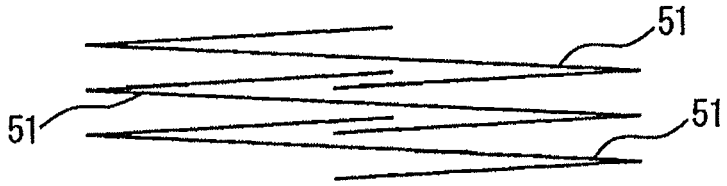
Figure 10C:
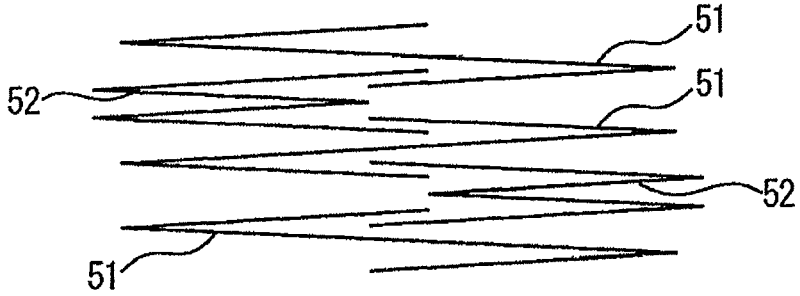

As a method of folding the wet tissue 5 packaged in the wet tissue package 1 in the present invention, for example, as shown in FIG. 10A, the long folded wet tissue 5 provided with a tear-off portion 14 such as perforation at predetermined intervals, as shown in FIG. 10B, a plurality of wet tissues 51 folded in a Z shape called Z folding in which ends thereof are made to mutually overlap, as shown in FIG. 10C, the plurality of wet tissues 51 folded in a Z shape and a plurality of wet tissues 52 folded in a W shape called WZ folding in which ends thereof are alternately made to mutually overlap and the like can be cited, but the method of folding is not limited to the above examples and various method of folding like folding combining vertical folding and horizontal folding can be adopted.

The invention claimed is:

1. A wet tissue package comprising:

an airtight bag body accommodating wet tissues;

an outlet member forming a wet tissue drawing hole mounted on an inner side around an opening of the bag body; and a cover member that seals the opening of the bag body, wherein the outlet member has a bottom having the wet tissue drawing hole and a side wall, and the outlet member is provided at a peripheral portion of the opening on an inner surface of the bag body, and the outlet member includes a concave space formed between the bottom, the side wall of the outlet member and the bag body to accommodate a wet tissue protruding from the wet tissue drawing hole, the side wall of the outlet member rising up in an upper direction from the bottom thereof, and the outlet member being formed such that a plane cross section of the concave space thereof becomes larger than an opening area of the opening of the bag body, wherein the wet tissue drawing hole is a picking portion and a pulling portion that are linked via a tapering portion of the picking portion, the pulling portion having an opening area that is smaller than the opening area of the picking portion, and the pulling portion is provided with a protrusion to apply a load to the wet tissue to be pulled out, the protrusion being separate from a convergence of the tapering portion.

2. The wet tissue package according to claim 1, wherein the outlet member includes the bottom where the wet tissue drawing hole is formed, the side wall rising from the bottom, and a flange portion provided on a peripheral portion of an upper end of the side wall, and the outlet member is mounted around the peripheral portion of the opening of the inner surface of the bag body through the flange portion.

3. The wet tissue package according to claim 1, wherein at least a portion of the side wall of the outlet member has a communicating portion into the bag body.

4. The wet tissue package according to claim 1, wherein the wet tissue in the bag body is picked and pulled up from the picking portion.

5. The wet tissue package according to claim 4, wherein the wet tissue is folded and stored such that a folding line of the wet tissue is perpendicular to a direction connecting the picking portion and the pulling portion of the wet tissue drawing hole.

6. The wet tissue package according to claim 1, wherein the outlet member is mounted on the bag body in a recessed position on the inner side of the bag body retracted behind from a periphery of the opening of the bag body.

7. The wet tissue package according to claim 2, wherein the flange portion formed at a portion by overhanging outwardly from the peripheral portion of an upper end portion of the side wall of the outlet member is joined on the portion which is retracted to the inner side of the bag body from a periphery of the opening of the bag body at the inner surface of the bag body, and the outlet member is mounted at the peripheral portion of the inner surface of the bag body.

8. The wet tissue package according to claim 1, wherein the outlet member is configured by processing and forming the wet tissue drawing hole in a plate body.

9. The wet tissue package according to claim 2, wherein the outlet member is configured by processing and forming the wet tissue drawing hole and the flange portion in a plate body.

10. The wet tissue package according to claim 1, wherein the outlet member is fixedly mounted around the opening of the inner surface of the bag body via a flange portion formed at a portion overhanging inwardly from a peripheral portion of the upper end portion of the sidewall of the outlet member.

11. The wet tissue package according to claim 1, the pulling portion is provided a slit to allow the wet tissue to be taken out easily one wet tissue after another by providing an elastic force to the load applied to the wet tissue by the protrusion.

12. The wet tissue package according to claim 3, the outlet member has four side walls, and a communicating portion is provided to only two opposite sidewalls within the four sidewalls.

13. The wet tissue package according to claim 3, the outlet member having four side walls, and a communicating portion being provided to the four sidewalls.

14. The wet tissue package according to claim 1, the cover member is a sheet-like cover.

15. The wet tissue package according to claim 1, the cover is a lid provided by integral formation with the outlet member.

16. The wet tissue package according to claim 1, wherein the pulling portion is provided with a protrusion opposite from a convergence of the tapering portion.

17. A package comprising:

a body accommodating tissues;

an outlet member forming a tissue drawing hole mounted on an opening of the body; and a cover member that covers the opening of the body, wherein the outlet member has a bottom having the tissue drawing hole and a side wall, the outlet member being provided at a peripheral portion of the opening of the body, the outlet member includes a concave space formed between the bottom and the side wall of the outlet member to accommodate a tissue protruding from the tissue drawing hole, the side wall of the outlet member rising up in an upper direction from the bottom thereof, the tissue drawing hole comprises a picking portion and a pulling portion that are linked via a tapering portion of the picking portion, the pulling portion having an opening area that is smaller than the opening area of the picking portion, and the pulling portion is provided with a protrusion to apply a load to the tissue to be pulled out, the protrusion being separate from a convergence of the tapering portion.

18. The package according to claim 17, wherein the pulling portion is provided with a protrusion opposite from a convergence of the tapering portion.

19. The package according to claim 17, wherein the pulling portion is provided with a slit.

20. The package according to claim 17, wherein the side wall comprises at least one communicating portion between the concave space and an outside of the concave space.

* * * * *